US005870650A

United States Patent [19]

Takahashi et al.

[11] Patent Number: 5,870,650

[45] Date of Patent: Feb. 9, 1999

[54] IMAGE FORMING APPARATUS HAVING A DEVICE TO APPLY A RELEASE AGENT TO A SURFACE OF A TRANSFER ROLLER

[75] Inventors: Mitsuru Takahashi, Kawasaki; Satoru Uchida, Tokyo, both of Japan

[73] Assignee: Ricoh Company, Ltd., Tokyo, Japan

[21] Appl. No.: 891,090

[22] Filed: Jul. 10, 1997

[30] Foreign Application Priority Data

Jul. 18, 1996 [JP] Japan ..... 8-189533
Jul. 23, 1996 [JP] Japan ..... 8-193564

[51] Int. Cl.[6] ..... G03G 15/16

[52] U.S. Cl. ..... 399/98; 399/101; 399/313

[58] Field of Search ..... 399/98, 101, 297, 399/313

[56] References Cited

U.S. PATENT DOCUMENTS

| | | | |
|---|---|---|---|
| 5,442,428 | 8/1995 | Takahashi et al. . | |
| 5,461,461 | 10/1995 | Harasawa et al. . | |
| 5,469,247 | 11/1995 | Cheng et al. | 399/350 |
| 5,510,886 | 4/1996 | Sugimoto et al. | 399/308 |
| 5,666,622 | 9/1997 | Harasawa et al. . | |
| 5,701,566 | 12/1997 | Bisaiji et al. . | |

FOREIGN PATENT DOCUMENTS

| | | |
|---|---|---|
| 6-337598 | 12/1994 | Japan . |
| 6-342234 | 12/1994 | Japan . |
| 7-239616 | 9/1995 | Japan . |
| 7-271142 | 10/1995 | Japan . |
| 7-271262 | 10/1995 | Japan . |

*Primary Examiner*—Joan Pendegrass
*Attorney, Agent, or Firm*—Oblon, Spivak, McClelland, Maier & Neustadt, P.C.

[57] ABSTRACT

An image forming apparatus includes a transfer device to transfer an image on an image carrier to a transfer sheet. The transfer device includes a transfer roller and transfers an image on the image carrier to a transfer sheet conveyed into a transfer area between the transfer roller and the image carrier by applying a bias voltage to the transfer roller. The transfer device includes a device to apply a release agent for an alien substance to a surface of the transfer roller. Toner and an alien substance, such as paper dust, thereby hardly adheres to the release agent applied on the surface of the transfer roller. Even if toner and/or an alien substance are put on the release agent applied on the surface of the transfer roller, such toner and/or an alien substance are easily removed by a cleaning device. Thus, lowering of an image quality due to insufficient cleaning of the transfer roller is avoided.

27 Claims, 8 Drawing Sheets

IMAGE FORMING APPARATUS HAVING A DEVICE TO APPLY A RELEASE AGENT TO A SURFACE OF A TRANSFER ROLLER

BACKGROUND OF THE INVENTION

1. Field of the Invention

The present invention relates to an image forming apparatus, such as a copying machine, a printer, a facsimile machine, etc., and more particularly relates to an image forming apparatus including an image transfer device having a transfer roller.

2. Discussion of the Background

In an image forming apparatus utilizing electrophotography, such as a copying machine, a printer, a facsimile machine, etc., an image transfer device is provided to transfer a toner image formed on an image carrier of the apparatus to a transfer sheet conveyed to a transfer position between the image carrier and the transfer device.

An example of an image transfer device includes a charger to apply a corona charge to a transfer sheet when transferring an image on the image carrier to the transfer sheet. Another example of an image transfer device includes a transfer roller which transfers an image formed on an image carrier to a transfer sheet by applying a voltage to the transfer roller when the transfer sheet passes through a transfer position between the transfer roller and the image carrier.

In such a transfer device including a transfer roller, since a surface of the transfer roller contacts a surface of the image carrier via a transfer sheet, toner on the surface of the image carrier is hardly transferred to the surface of the transfer roller. However, when multiple images are formed in succession on the image carrier, such as when making multiple copies, since a gap exists between the images, toner adhering to a part of the image carrier corresponding to the gap is transferred to the surface of the transfer roller. Further, when a transfer sheet to be conveyed to the transfer position jams and is not conveyed to the transfer position, a toner image formed on the surface of the image carrier directly contacts the surface of the transfer roller, and as a result the toner is put on the surface of the transfer roller.

If a next toner image is then formed to be transferred to a next transfer sheet, when the next transfer sheet passes the transfer position for the transfer, such toner put on the surface of the transfer roller is transferred to a back surface of the next transfer sheet. When a duplex copy is made, after an image is transferred to a first surface of a transfer sheet, the transfer sheet carrying the transferred image on the first surface is returned so that another toner image is transferred to the back surface. Therefore, if the back surface of the transfer sheet is stained by toner remaining on the surface of the transfer roller when transferring the image to the first surface of the transfer sheet, the image transferred to the back surface next is disturbed by such toner transferred from the transfer roller. Further, since the first surface of the transfer sheet on which the image is first transferred contacts the transfer roller, the image on the first surface is also damaged by the toner remaining on the transfer roller if any toner remains on the transfer roller.

Therefore, in background image forming apparatuses, a cleaning device is provided to scrape off toner adhering to a surface of a transfer roller, such as, for example, a cleaning blade made of rubber or the like. Toner is scraped off the transfer roller by bringing an edge of the cleaning blade in contact with the surface of the transfer roller which is rotating.

Further, a mechanism is provided to separate the cleaning blade from the transfer roller when cleaning is not performed, for preventing damage to the surface of the transfer roller.

Further, in order to achieve optimum cleaning performance of the cleaning blade, a control mechanism is provided to control a pressing force to press the cleaning blade against the surface of the transfer roller.

However, even when such a cleaning device is provided for cleaning the surface of the transfer roller, a surface of the transfer roller is not cleaned sufficiently when an amount of toner adhering to the surface of the transfer roller is large. For example, when an image is formed in a full color, an amount of toner applied to the image for development is large compared to a case in which the image is formed in a mono-color, and consequently toner adhering to the surface of the transfer roller increases. Therefore, the toner adhering to the surface of the transfer roller is not completely removed by the cleaning device.

Further, when a certain type of transfer sheet is used, a problem occurs that paper dust of the transfer sheet adheres to the surface of the transfer roller. When the transfer device uses a transfer roller, since the transfer sheet is pressed by the transfer roller to the image carrier and is rubbed by the transfer roller, the transfer sheet produces paper dust. Therefore, when the transfer sheet contains a relatively large amount of calcium carbonate, for example, the paper dust coming off the transfer sheet contains calcium carbonate. Such paper dust containing calcium carbonate adheres to the surface of the transfer roller, forming a film thereupon. Such a film can not be easily scraped off by the cleaning device even when the pressing force pressing the cleaning device against the transfer roller is optimized. If the film remains on the surface of the transfer roller and toner is put on the film, the toner adheres to the film and can not be easily removed from the film.

SUMMARY OF THE INVENTION

The present invention has been made in view of the above-discussed problems and to address and resolve these problems.

Accordingly, an object of the present invention is to provide a novel image forming apparatus with a simple structure, in which toner and an alien substance, such as paper dust or the like, hardly adheres to a surface of a transfer roller and, even when toner and an alien substance are put on the surface of the transfer roller, the toner and the alien substance are easily removed, such that lowering of image quality due to insufficient cleaning of the transfer roller is avoided.

In order to achieve the above-mentioned objects, a novel image forming apparatus according to the present invention includes a transfer device to transfer an image on an image carrier to a transfer sheet. The transfer device includes a transfer roller and transfers an image on the image carrier to a transfer sheet conveyed to a transfer position between the transfer roller and the image carrier by applying a bias voltage to the transfer roller. The transfer device includes a release agent applying device to apply a release agent for an alien substance to a surface of the transfer roller. Since toner and an alien substance, such as paper dust or the like, hardly adhere to the release agent applied to the surface of the transfer roller, lowering of image quality due to insufficient cleaning of the transfer roller is prevented.

As the release agent, zinc stearate may be used, because zinc stearate is easily coated to form a layer on a surface of the transfer roller. Toner and an alien substance hardly adheres to a surface of the zinc stearate layer. Further, even when toner and an alien substance adhere to a surface of the zinc stearate layer, such a toner and an alien substance can be easily removed.

The transfer device may further include a cleaning member to clean a surface of the transfer roller by bringing the cleaning member into contact with the surface of the transfer roller. A width to which the release agent is applied by the release agent applying device may be made narrower than a width the cleaning member cleans, such that a whole surface of the release agent layer is cleaned by the cleaning blade. Thus, toner and paper dust adhering to the surface of the release agent layer can be completely removed.

Further, the release agent applying device may apply the release agent to the surface of the transfer roller at all times when the transfer roller is rotating, such that paper dust coming off the transfer sheet is prevented from accumulating on the surface of the transfer roller.

The release agent may be solidified and the release agent applying device may be configured such that the solid release agent directly contacts the surface of the transfer roller. With such a configuration using a solid release agent, the number of parts of the release agent applying device is reduced and the structure is made simple, and as a result, a cost of the apparatus is reduced.

The transfer device may include an elastic intermediate agent applying member between the transfer roller and the release agent applying device, so that the release agent is applied to a surface of the transfer roller via the intermediate agent applying member. By having such an elastic intermediate agent applying member, a surface of the transfer roller is prevented from being damaged by the release agent directly contacting a surface of the transfer roller.

Furthermore, the transfer device may include a guide member to guide a transfer sheet to a transfer area between the transfer roller and the image carrier, and the release agent applying dcvice may be configured to include a bracket to hold the release agent along a longitudinal surface of the transfer roller. The bracket may be rotatably supported by the guide member and a pressing member presses the bracket, so that the release agent contacts the longitudinal surface of the transfer roller. When the transfer roller rotates, the release agent is applied to the surface of the transfer roller. The release agent applying device may be constructed in an integrated assembly, such that the release agent is integrally supported by the bracket and the bracket is integrally and rotatably supported by the guide member, and such that the release agent applying device is easily mounted to the transfer device at a predetermined position.

For pressing the bracket, a plurality of pressing members may be provided, being equally spaced from each other along the longitudinal surface of the transfer roller. Each of the plurality of pressing members presses the bracket with an equal pressing force, such that the release agent contacts the surface of the transfer roller at a substantially uniform pressing force along the longitudinal direction of the transfer roller even when the surface of the bracket supporting the release agent is not uniformly flat. Thus, the release agent is uniformly applied to the longitudinal surface of the transfer roller.

Still furthermore, the image forming apparatus of the present invention may be provided with a control device to rotate only the transfer roller while stopping an image forming operation including feeding of a transfer sheet. The apparatus may also be provided with a select device to select such a mode to rotate only the transfer roller while stopping the image forming operation. When the transfer roller or the release agent is replaced, by selecting such a mode via the select device, the release agent can be applied on the surface of the transfer roller until forming a same uniform layer of the release agent as before the replacement without continuously forming images and thereby without wasting a large number of transfer sheets.

BRIEF DESCRIPTION OF THE DRAWINGS

A more complete appreciation of the present invention and many of the attendants advantages thereof will be readily obtained as the same becomes better understood by reference to following detailed description when considered in conjunction with the accompanying drawings, wherein.

DESCRIPTION OF THE PREFERRED EMBODIMENTS

Figure 1:
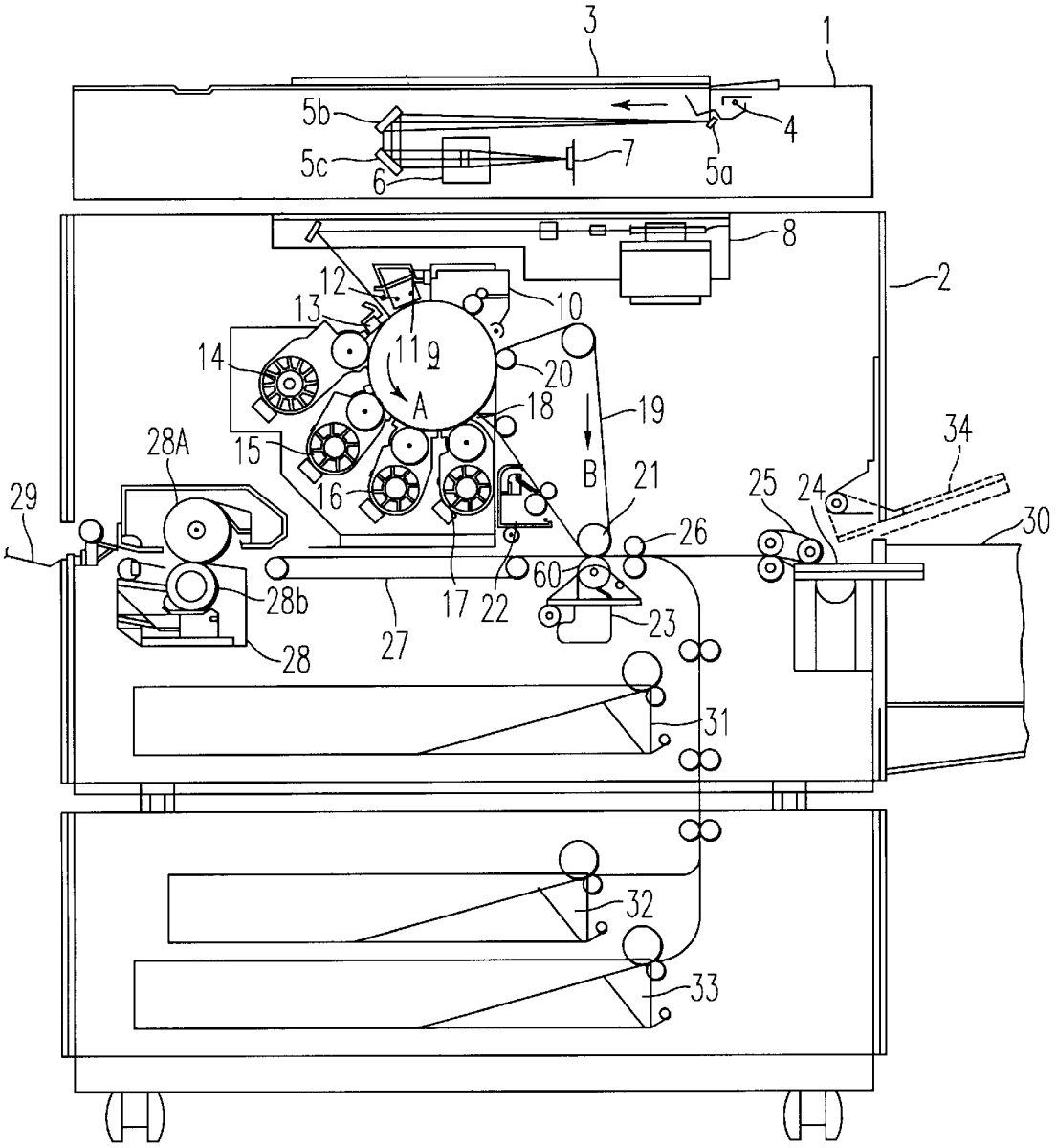
FIG. 1 is a schematic drawing illustrating an overall structure of a full color copying machine as an example of an image forming apparatus of the present invention.

Referring now to the drawings, wherein like reference numerals designate identical or corresponding parts throughout the several views, embodiments of the present invention are now explained.

Figure 2:
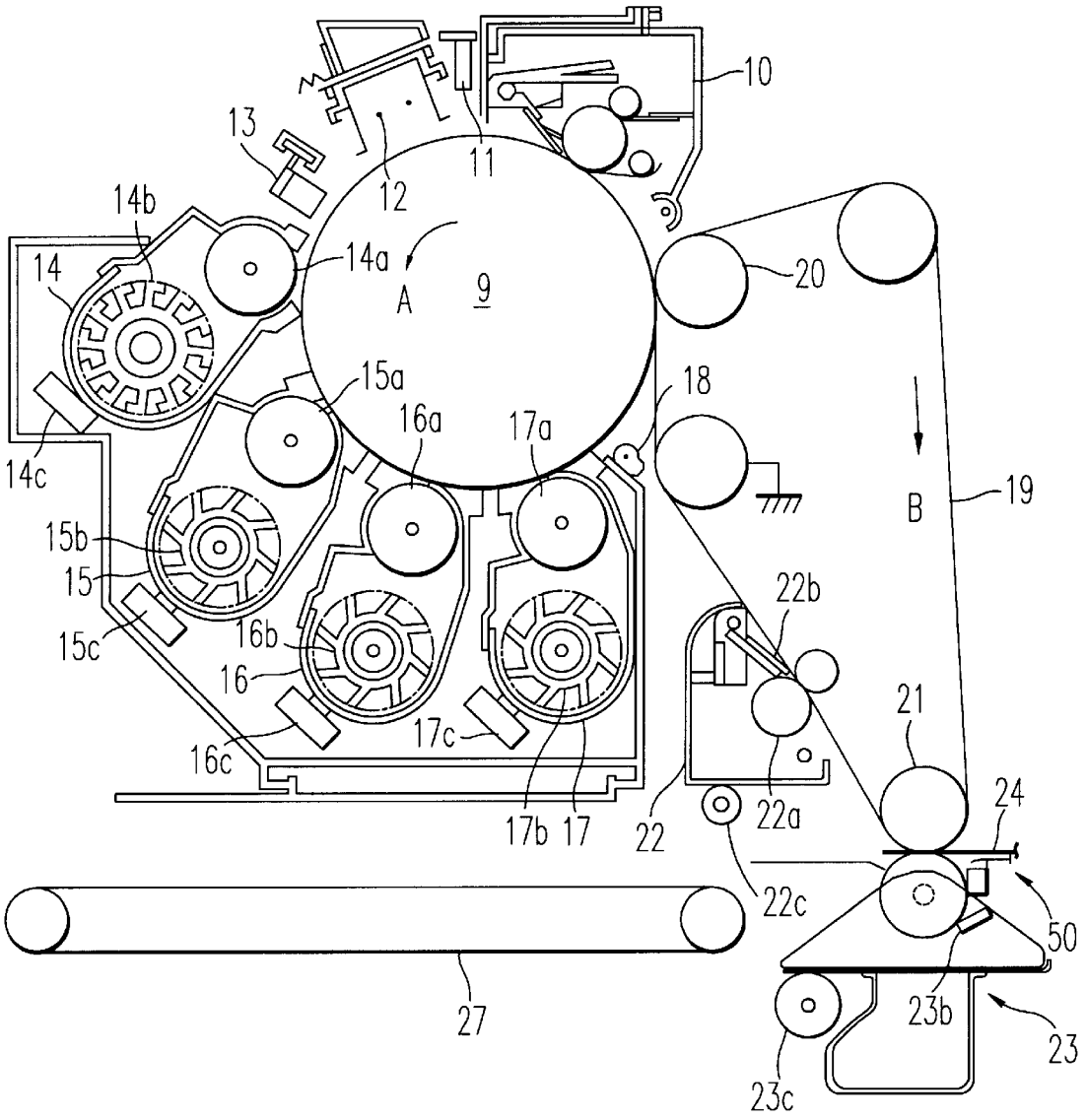
FIG. 2 is an enlarged view of an image forming part of the color copying machine shown in FIG. 1.
Figure 3:
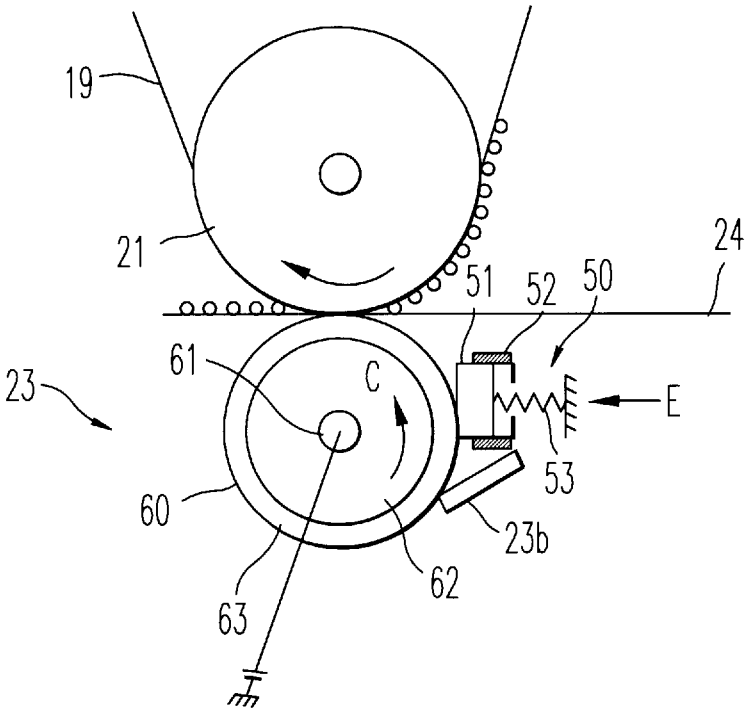
FIG. 3 is a schematic drawing from a front illustrating a structure of a transfer device including a release agent applying device, which is included in the color copying machine shown in FIG. 1.

FIG. 1 is a schematic drawing illustrating an overall structure of a full color copying machine as an example of an image forming apparatus of the present invention, FIG. 2 is an enlarged view of an image forming part of the color copying machine shown in FIG. 1 and FIG. 3 is a schematic drawing from the front illustrating a structure of a transfer device included in the color copying machine shown in FIG. 1.

As shown in FIG. 1, the color copying machine as an image forming apparatus includes a color scanner 1 on top of a color printer 2.

The color printer 2 includes a photoconductive drum 9 as an image carrier to form a latent image thereupon. Arranged around the photoconductive drum 9 are a black color developing unit 14, a cyan color developing unit 15, a magenta color developing unit 16 and a yellow color developing unit 17 to develop a latent image formed on the photoconductive drum 9 to a toner image of a corresponding color respectively. The color printer 2 further includes an intermediate transfer belt 19 to which toner images are transferred from the photoconductive drum 9. The photoconductive drum 9 carries a toner image to a transfer position to transfer the toner image to the intermediate transfer belt 19 by rotating thereof.

The intermediate transfer belt 19 carries the transferred toner image to a position to transfer the toner image to a transfer sheet 24, where a transfer unit 23 as a transfer device for transferring an image to the transfer sheet 24 is arranged. Further, a conveying belt 27 is provided to convey the transfer sheet 24 carrying the toner image thereupon to a fixing unit 28 where the toner image carried on the transfer sheet 24 is fixed to the transfer sheet 24.

The color scanner 1 includes a lamp 4 to light an original document 3 to be imaged. The light reflected from a surface of the original document 3 is imaged to a color sensor 7 via mirrors 5*a*, 5*b*, 5*c* and a lens 6. The color sensor 7 includes a color separating device to separate colors of light to black, green and red, and an optic-to-electric converter, such as, for example, a charge-coupled device, to convert light to an electric signal. The color sensor 7 reads color image data for the original document by separating the colors of the imaged light to black, green and red. The line sensor 7 in this example reads color image data for three colors at one time in one operation.

Then, an image processor (not shown) performs color conversion in accordance with a signal level of each signal for black, green and red to generate color image data for black, cyan, magenta and yellow respectively.

The color printer 2 further includes a laser writing unit 8, which irradiates laser light corresponding to the image data for each color on a surface of the photoconductive drum 9 to form a corresponding latent image thereupon.

Each of the latent images for black, cyan, magenta and yellow is respectively developed in sequence by corresponding color toner in the developing units 14, 15, 16, 17 to form a toner image, which toner images are then transferred to the intermediate transfer belt 19 one by one. Each toner image is superimposed with others when transferred to the intermediate transfer belt 19 to form a full color image on the intermediate transfer belt 19.

The color scanner 1 reads the original document 3 by moving the lamp 4 towards the left in FIG. 1 synchronized with a movement of the color printer 2. Since the color copying machine shown in FIG. 1 does not include a memory to store image data, reading of an original document is performed four times to obtain color image data for four colors.

Around the photoconductive drum 9, besides the developing units 14, 15, 16, 17 for each color and the intermediate transfer belt 19, there are arranged a cleaning unit 10 to clean a surface of the photoconductive drum 9, a discharge lamp 11 to discharge a surface of the photoconductive drum 9, a charger 12 to charge a surface of the photoconductive drum 9, a charge sensor 13 to sense a charge level on the photoconductive drum 9 and a developing density detector 18 to detect a density of a toner image formed on the photoconductive drum 9.

As shown in FIG. 2, the developing units 14, 15, 16, 17 respectively include developing rollers 14*a*, 15*a*, 16*a*, 17*a*, which rotate so that developer sleeves or ears formed on the surfaces of the developing rollers 14*a*, 15*a*, 16*a*, 17*a* contact a surface of the photoconductive drum 9 to develop a latent image on the photoconductive drum 9. The developing units 14, 15, 16, 17 further include respective developer paddles 14*b*, 15*b*, 16*b*, 17*b* to scoop up and agitate the developer and toner density sensors 14*c*, 15*c*, 16*c*, 17*c* to detect density of toner in the developing units 14, 15, 16, 17. In this embodiment, reading of an original document for each color and development of an image for each color are performed in the order of black, cyan, magenta and yellow.

When an operation of forming a color image is started with the above-described color copying machine, the photoconductive drum 9 rotates in a direction indicated by an arrow in FIGS. 1 and 2 and the charger 12 uniformly charges the surface of the photoconductive drum 9. After image data for a plurality of colors corresponding to the color image of the original document 3, which is sent from the color scanner 1, is processed by an image processor (not shown), the laser writing unit 8 irradiates laser light corresponding to the color image data, black image data in this case, onto the charged surface of the photoconductive drum 9 to form a corresponding black latent image thereupon.

The black developing roller 14*a* of the black developing unit 14 is rotated so as to form developer sleeves or ears therefrom before a leading edge of the latent image for black formed on the surface of the photoconductive drum 9 reaches the developing position of the black developing unit 14, so that the latent image for black is developed to a black toner image by the black developing unit 14.

When a trailing edge of the black latent image passes the developing position of the black developing unit 14, the formation of developer sleeves or ears on the black developing roller 14*a* is immediately stopped to disable the development by the black developing unit 14. Such a stoppage of the formation of developer sleeves or ears is made by changing a rotation of the black developing roller 14*a* in an opposite direction and has to be completed before a leading edge of the cyan latent image according to cyan image data of the original document reaches the developing position of the black developing unit 14.

The black toner image thus formed on the surface of the photoconductive drum 9 is then transferred to a surface of the intermediate transfer belt 19 which is rotating in an adjacent position at a same rotating speed as the photoconductive drum 9. The image is transferred from the photoconductive drum 9 to the intermediate transfer belt 19 by applying a predetermined bias voltage to an intermediate transfer bias roller 20 which is arranged in a transfer position contacting the photoconductive drum 9 via the intermediate transfer belt 19. The bias voltage is applied with a bias electric source (not shown) when a part of the photoconductive drum 9 carrying the toner image is in contact with the intermediate transfer belt 19.

After transfer of the image, residual toner on the photoconductive drum 9 is removed by the cleaning unit 10 and then the photoconductive drum 9 is discharged by the discharge lamp 11, so that a next image forming operation can be started.

Following completion of the transfer of the black toner image to the intermediate transfer belt 19, the color scanner 1 reads a cyan image at a predetermined timing, and then laser writing in accordance with the cyan image data is performed to form the cyan latent image on a surface of the photoconductive drum 9.

The cyan developing unit 15 starts rotating the cyan developing roller 15*a* to form developer sleeves or ears around the surface thereof after the trailing edge of the black latent image passes the developing position of the black developing unit 14, and before a leading edge of the cyan latent image reaches the developing position of the cyan developing unit 15, so that the cyan latent image is developed by the cyan developing unit 15.

As in the black developing unit 14, when a trailing edge of the cyan latent image passes the developing position of the cyan developing unit 15, formation of the developer sleeves or ears on the cyan developing roller 15*a* is immediately stopped to disable the development by the cyan developing unit 15. Such a stoppage of the formation of developer sleeves or ears has to be completed before a leading edge of the magenta latent image according to the magenta image data of the original document reaches the developing position of the cyan developing unit 15.

Like the black toner image, the cyan toner image thus formed on the photoconductive drum 9 is then transferred onto the intermediate transfer belt 19 to be superimposed on the black toner image previously transferred thereto. After the transfer, the surface of the photoconductive drum 9 is cleaned by the cleaning unit 10 and is discharge by the discharge lamp 11 so that a next image forming operation can be started.

In the same manner, a magenta image and a yellow image are developed by the respective developing units 16, 17, and are transferred onto the intermediate transfer belt 19. By thus transferring a toner image for each color onto the intermediate transfer belt 19 one by one in sequence superimposing one image after another, a full color image is formed on the intermediate transfer belt 19.

Although the toner images are formed in order of black, cyan, magenta and yellow in this example, the order of formation is not limited to such and may be predetermined in any way depending upon characteristics of the toner used and/or the image quality to be obtained.

The full color toner image thus formed on the intermediate transfer belt 19 is then transferred to a transfer sheet 24 by the transfer unit 23.

The transfer sheet 24 to which the full color toner image is transferred is conveyed to the fixing unit 28 by the conveying belt 27. The toner image is fixed to the transfer sheet 24 between a fixing roller 28*a* heated to a predetermined temperature and a pressing roller 28*b*. The transfer sheet 24 carrying the fixed toner image is then output to a copy tray 29, and thus a full color image is obtained.

The intermediate transfer belt 19 is spanned around the intermediate transfer bias roller 20, a driving roller 21 and a series of supporting rollers, and is rotated in a direction indicated by an arrow in FIGS. 1 and 2 by a driving motor (not shown). Further a surface of the intermediate transfer belt 19 is cleaned by a belt cleaner 22 provided adjacent to the intermediate transfer belt 19.

The belt cleaner 22 includes a brush roller 22*a*, a rubber blade 22*b* and a separate/contact device 22*c* as shown in FIG. 2. The belt cleaner 22 is in contact with the intermediate transfer belt 19 before a black toner image is transferred to the intermediate transfer belt 19. When transfer of the black toner image to the intermediate transfer belt 19 starts, the belt cleaner 22 is separated from the intermediate transfer belt 19 by the separate/contact device 22*c*.

As shown in FIG. 3, the transfer unit 23 in this embodiment includes a transfer roller 60, a cleaning blade 23*b* and a release agent applying device 50 for applying a release agent 51 on a surface of the transfer roller 60 so that toner and an alien substance, such as paper dust and the like, does not adhere to the surface of the transfer roller 60. Further, as shown in FIG. 2, a separate/contact device 23*c* for separating the transfer roller 60 from and bringing the transfer roller 60 into contact with the intermediate transfer belt 19 may be provided.

The transfer roller 60 includes a rubber layer 62 formed around a transfer roller axis 61 and a plastic coating layer 63 formed around the rubber layer 62.

The transfer roller 60 is separated from the intermediate transfer belt 19 except when transferring a color toner image on the intermediate transfer belt 19 to a transfer sheet 24. When transferring such an image, the transfer roller 60 is moved towards the intermediate transfer belt 19 at a predetermined timing to contact and press a transfer sheet 24 conveyed into the transfer position to the intermediate transfer belt 19, and the toner image is transferred to the transfer sheet 24 by applying a predetermined bias voltage to the transfer roller 60.

As shown in FIG. 1, the transfer sheet 24 is stored, depending upon its size, in any of transfer sheet cassettes 30, 31, 32, 33, respectively accommodating a transfer sheet 24 of a particular size. If a selected size for the transfer sheet 24 is designated via an operational panel (not shown), a transfer sheet 24 of the selected size is fed out from the appropriate transfer sheet cassette accommodating the transfer sheet 24 of such a size and the transfer sheet 24 is conveyed towards the pair of registration rollers 26. Numeral 34 in FIG. 1 denotes a manual feeding tray with which transfer sheets which are not suitable for feeding out from the transfer sheet cassettes 30, 31, 32, 33, such as, for example, a thick paper or a transparent film for use in an overhead projection device, are fed in manually.

When making multiple copies of an original document in succession with such a color copying machine, following the completion of forming the image for the fourth color, i.e. yellow, for the first copy, an image forming operation for the first color, i.e. black, for the second copy is commenced at a predetermined timing. In such a case, the black toner image for the second copy is transferred from the photoconductive drum 9 to the intermediate transfer belt 19 after the full color toner image on the intermediate transfer belt 19 is transferred to a transfer sheet 24 as the first copy and after a surface of the intermediate transfer belt 19 is cleaned by the belt cleaner 22. The following operations for the second copy are the same as for the first copy.

The above explanation has been made for a case that an image is formed in full colors. That is, the image forming operation is performed four times, namely, one each for black, cyan, magenta and yellow, for making one full color copy, and the above-discussed operations are repeated the number of times corresponding to the designated number of copies. Likewise, in a case that an image is formed in three colors or two colors, the operation of forming the image is performed a corresponding numbers of times.

When making an image in a single color, until a designated number of copies are made, a developing unit for the designated color is kept in a condition for developing a latent image, the intermediate transfer belt 19 is kept rotating at a predetermined speed while contacting the surface of the photoconductive drum 9, and the belt cleaner 22 is kept contacting the intermediate transfer belt 19.

As described above, the transfer unit 23 includes the release agent applying device 50 as shown in FIG. 3.

Figure 4:
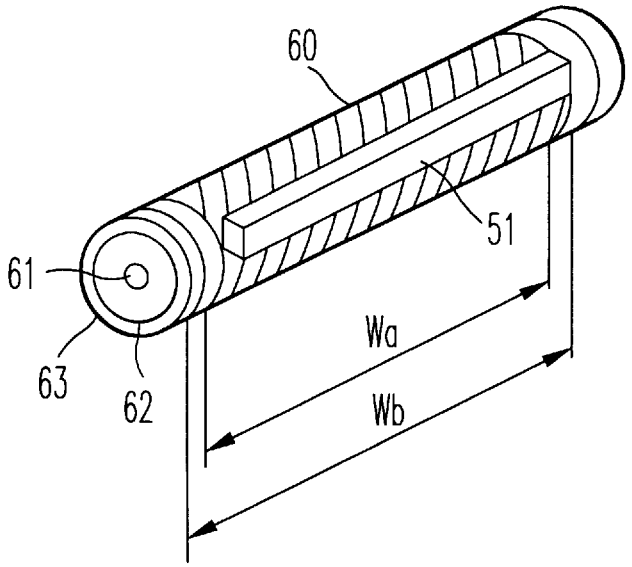
FIG. 4 is a perspective drawing illustrating a transfer roller of the transfer device shown in FIG. 3, with a release agent contacting a surface of the transfer roller.

The release agent applying device 50 includes a solid release agent 51 disposed downstream of a position where the cleaning blade 23*b* contacts the transfer roller 60 in the rotating direction of the transfer roller 60. The solid release agent 51 is held by a holder 52 which is movable in the direction indicated by an arrow E. The solid release agent 51 is pressed by a pressing spring 53, which is attached to a right side surface of the solid release agent 51 in FIG. 3, with a predetermined pressing force, so that a surface of the solid release agent 51 facing the transfer roller 60 contacts a surface of the transfer roller 60 along an entire surface in a longitudinal direction, as also shown in FIG. 4. When the transfer roller 60 is rotating, the release agent 51 is coated on the surface of the transfer roller 60 to form a layer of the release agent 51 thereon.

In this example, as the solid release agent 51, zinc stearate which is solidified and is formed in a bar is used as shown in FIG. 4.

Toner and an alien substance, such as, for example, paper dust, hardly adheres to a surface of the layer of the release agent 51. Even if toner and/or paper dust are put on the surface of the layer of the release agent 51, such toner and/or paper dust can be easily removed therefrom. Thus, in the present invention lowering of image quality due to insufficient cleaning of the transfer roller 60 is avoided.

As described earlier, when the transfer sheet 24 contains a relatively large amount of calcium carbonate, paper dust oozed out from the transfer sheet 24 contains calcium carbonate. Such paper dust containing calcium carbonate, when adhering to a surface of the transfer roller 60, forms a film, which is hardly scraped off by the cleaning blade 23*b*. If such a film remains on the surface of the transfer roller 60 and toner adheres to this film, it becomes harder to remove the toner adhering to this film.

As an example, in an experiment with a background image forming apparatus, after about 500 sheets of the transfer sheet 24 including a relatively large amount of calcium carbonate have passed through a transfer position between the transfer roller 60 and the intermediate transfer belt 19, it has been observed that a surface of the transfer roller 60 becomes white with the paper dust and that the cleaning blade 23*b* can not scrape off the paper dust adhering to the surface of the transfer roller 60.

However, in an image forming apparatus of this invention with the transfer device 23 including the above-described release agent applying device 50 in which zinc stearate is used as the release agent, it has been observed that a surface of the transfer roller 60 does not become white with paper dust, that is, adhering of paper dust including calcium carbonate is considerably reduced due to a coating of a release agent 51 on a surface of the transfer roller 60. Further, it has been observed that even when toner adheres to the surface of the coated layer of the release agent 51, such toner is easily removed by the cleaning blade 23*b*.

In the release agent applying device 50 configured as described above, if the coating width of the release agent 51 is made too wide, an excessive amount of the release agent 51 is coated on the surface of the transfer roller 60. Then, when the transfer roller 60 rotates an excessive load is given to the release agent 51 due to the excessive coating of the release agent 51 on the transfer roller 60, which may cause the release agent 51 formed in a bar to break.

Therefore, in this embodiment, as shown in FIG. 4, a coating width W*a* of the release agent 51 is made narrower than a cleaning width W*b* of the cleaning blade 23*b*. As a result, the load given to the release agent 51 is reduced, and thereby a possibility of breaking the release agent 51 is avoided. Further, because a cleaning area of the cleaning blade 23*b* covers an entire coating area of the release agent 51, an entire surface of the coated layer of the release agent 51 is cleaned by the cleaning blade 23*b*. Thus, toner and paper dust adhering to a surface of the coated layer of the release agent 51 is easily removed.

Figure 5:
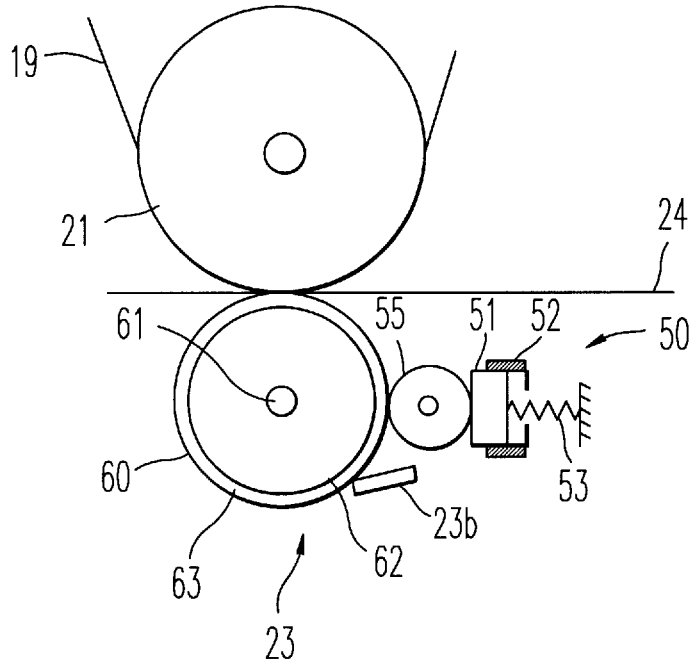
FIG. 5 is a schematic drawing illustrating a structure of another transfer device including an intermediate agent applying device from the front.

FIG. 5 is a schematic drawing showing a structure of another example of a transfer device according to the present invention. In FIG. 5, corresponding parts are indicated by the same numerals as in FIG. 3.

A transfer unit 23 in this example includes a release agent applying device 50 using the same solid release agent 51 as in the transfer unit 23 shown in FIG. 3. In this example, an intermediate agent applying member 55 is provided between the release agent 51 and the transfer roller 60 for applying the release agent 51 on the surface of the transfer roller 60 via the intermediate agent applying member 55. The intermediate agent applying member 51 is made of an elastic material so as not to damage a surface of the transfer roller 60.

As the intermediate agent applying member 55, a sponge formed in a cylinder or a fur brush roller, with substantially a same length as the release agent 51, may be used, for example.

With such a construction, because a surface of the transfer roller 60 contacts the intermediate agent applying member 55 which is made of an elastic material and which has a coated layer of the release agent 51 around the circumferential surface, the surface of the transfer roller 60 is uniformly coated with the release agent 51, and further, it is avoided that the surface of the transfer roller 60 is damaged.

Next, another example of a transfer device according to the present invention is explained with reference to FIGS. 6, 7 and 8.

Figure 6:
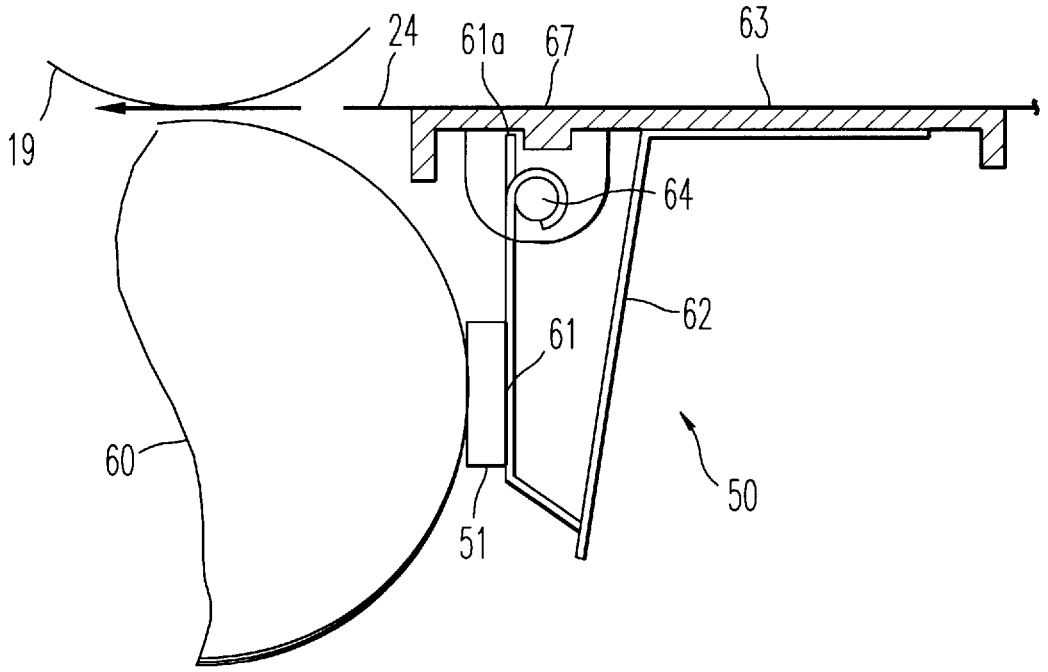
FIG. 6 is a schematic drawing illustrating a structure of another transfer device including another release agent applying device.
Figure 7:
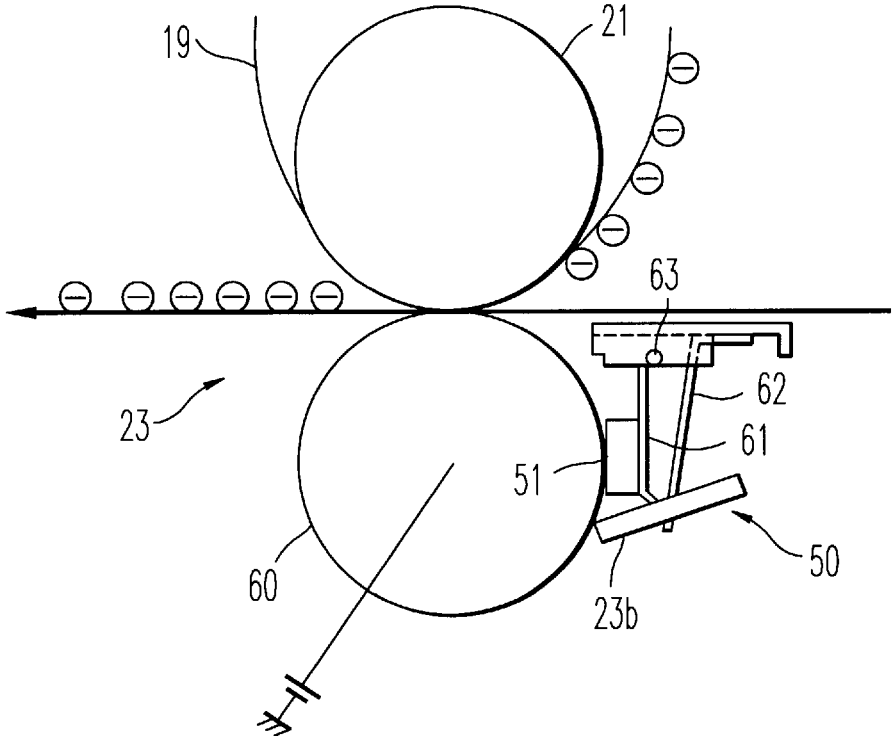
FIG. 7 is a schematic drawing illustrating the transfer device shown in FIG. 6, with an intermediate transfer belt.
Figure 8:
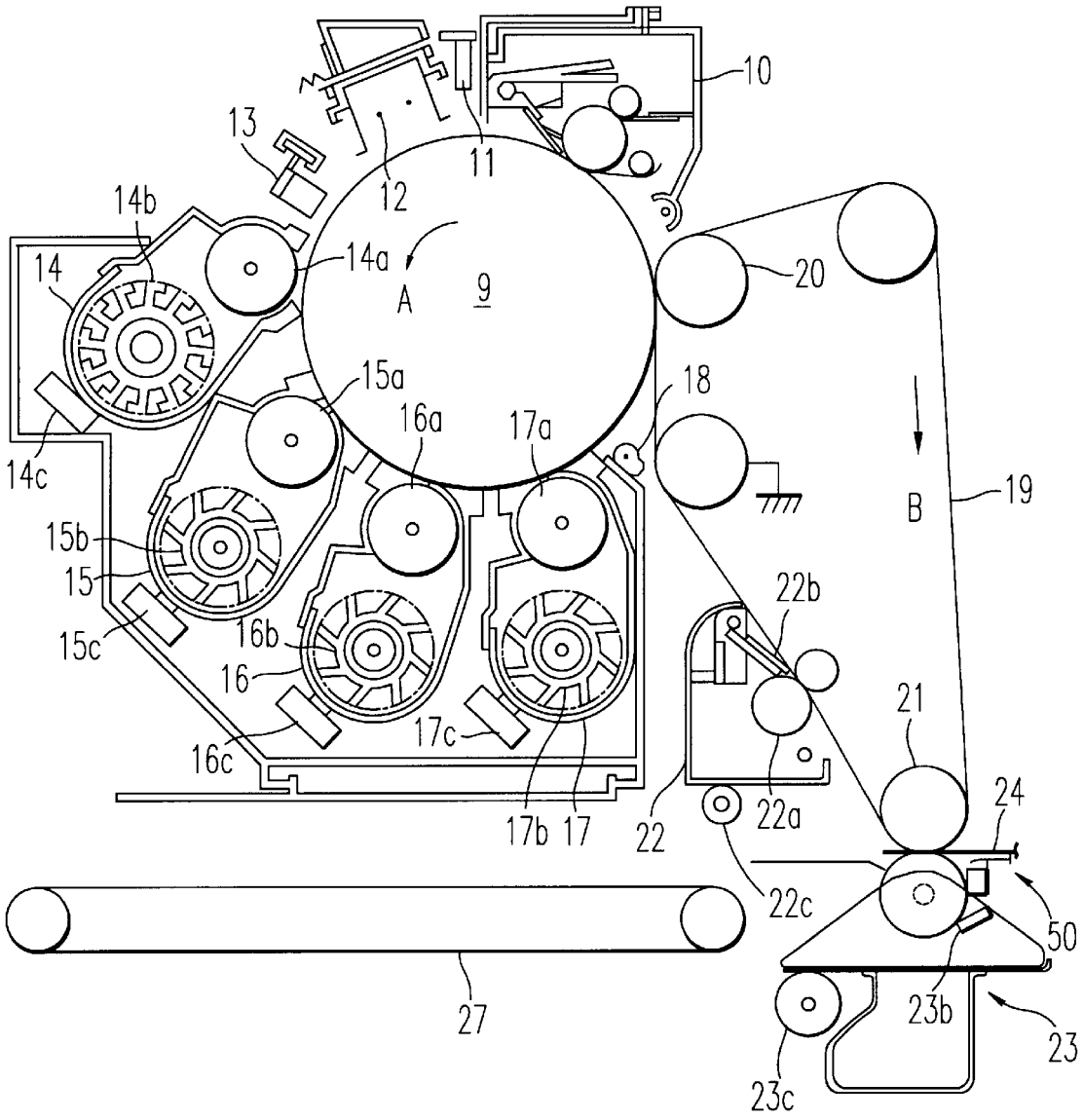
FIG. 8 is a schematic drawing illustrating an image forming part of an image forming apparatus including the transfer device shown in FIG. 6.

FIG. 6 is a schematic drawing illustrating a structure of another example of a transfer device according to the present invention from a front view, FIG. 7 is a schematic drawing illustrating the same transfer device with an intermediate transfer belt and FIG. 8 is a schematic drawing illustrating a main part of an image forming apparatus including the transfer device shown in FIGS. 6 and 7.

As shown in FIGS. 6 and 7, a transfer unit 23 as the transfer device includes a transfer roller 60, a cleaning blade 23*b*, a release agent applying device 50 including a solid release agent 51, a bracket 61 to support the release agent 51 along a longitudinal surface of the transfer roller 60 and a plurality of plate springs 62 as a pressing device to press the bracket 61 so as to bring the release agent 51 uniformly in contact with the transfer roller 60 along an entire longitudinal surface of the transfer roller 60, a guide plate 63 as a guide member to guide a transfer sheet 24 into a transfer area between the transfer roller 60 and an intermediate transfer belt 19 and a separate/contact device 23*c*, shown in FIG. 8, to separate the transfer roller 60 from and to bring the transfer roller 60 in contact with the intermediate transfer belt 19. For convenience sake, the guide plate 63 is shown as a sectional view.

The release agent applying device 50 further includes an axis 64 fixed to an upper end of the bracket 61 at each end thereof in the longitudinal direction, and the axis 64 is rotatably supported by the guide plate 63.

Figure 9:
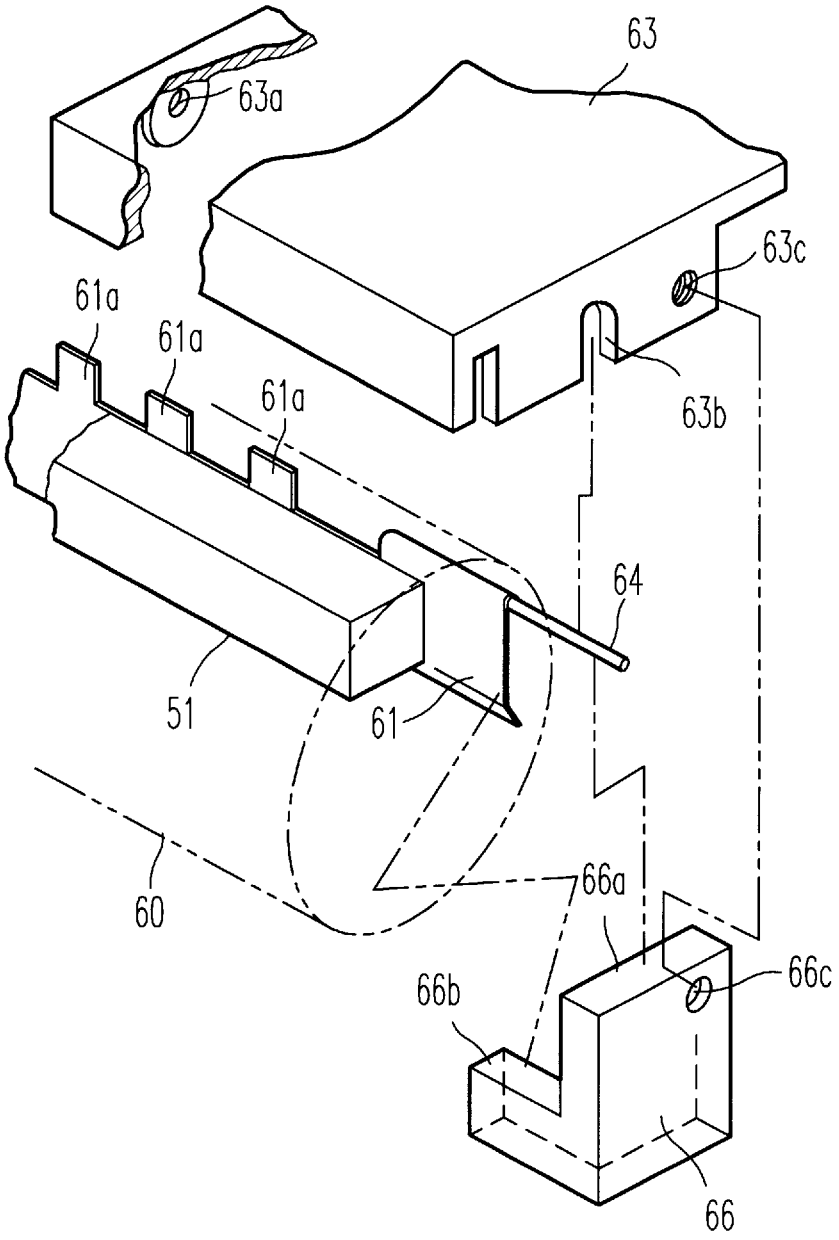
FIG. 9 is a perspective exploded drawing illustrating a structure of the release agent applying device shown in FIG. 6.

FIG. 9 is a perspective exploded drawing for explaining in more detail a construction of the release agent applying device 50.

The release agent 51 is made of zinc stearate and is formed in a solid square bar extending along the longitudinal surface of the transfer roller 60 as shown in FIG. 9. The release agent 51 is fixed to the bracket 61 by sticking a back side of the release agent 51 to the bracket 61.

The bracket 61 is formed in a thin plate extending in the longitudinal direction of the transfer roller 60 and the lower part of the bracket 61 is bent. The lower end of the bracket 61 is pressed uniformly by a plurality of plate springs 62 (not shown in FIG. 9), which are arranged separated from each other at an equal spacing in the longitudinal direction of the bracket 61 and which are fixed to an under surface of the guide plate 63, so that the release agent 51 is uniformly brought into contact with the surface of the transfer roller 60. In this example, four plate springs 62 are provided.

It is preferable that a total pressing force by the four plate springs 62 pressing the bracket 61 is set to about 0.5 newton to about 2 newton. If the total pressing force is too weak, the release agent 51 can not be applied to the surface of the transfer roller 60. If the total pressing force is too strong, on the other hand, friction between the release agent 51 and the transfer roller 60 increases, and there then occurs a possibility that the release agent 51 sticks to the surface of the transfer roller 60 and the release agent 51 rotates together with the bracket 61 as the transfer roller 60 rotates. By setting the total pressing force of the plate springs 62 to such a force as described above, sticking of the release agent 51 to the surface of the transfer roller 60 is prevented and the release agent 51 is properly applied to the transfer roller 60.

Further, by thus arranging the plurality of plate springs 62 in positions equally spaced from each other along the longitudinal direction of the transfer roller 60 and setting the pressing force of each of the plurality of plate springs 62 to an equal pressing force, the release agent 51 contacts the surface of the transfer roller 60 at a substantially uniform pressing force along the longitudinal direction of the transfer roller 60, and thereby the release agent 51 is uniformly applied to the surface of the transfer roller 60 even when the surface of the bracket 61 supporting the release agent 51 is not uniformly flat. Thus, it is thereby avoided that some part of the transfer roller 60 is not coated with the release agent 51.

Further, the bracket 61 may include protruding pieces 61*a* at a center thereof in the longitudinal direction. In this example, as shown in FIG. 9, the bracket 61 is provided with three protruding pieces 61*a* spaced from each other. The number of the protruding pieces 61*a* may be determined to an appropriate number. The bracket 61 integrally holds the axis 64 provided at each end of the bracket 61 by bending an upper end part of the bracket 61 in a curl form and caulking the upper end part of the bracket 61 around the axis 64.

On the other hand, the guide plate 63 includes an axis support opening 63*a* to insert the axis 64 therein and to rotatably support the axis 64 at a rear side and a U-shaped groove 63*b* to insert therein the axis 64 therein at the other end.

Figure 10:
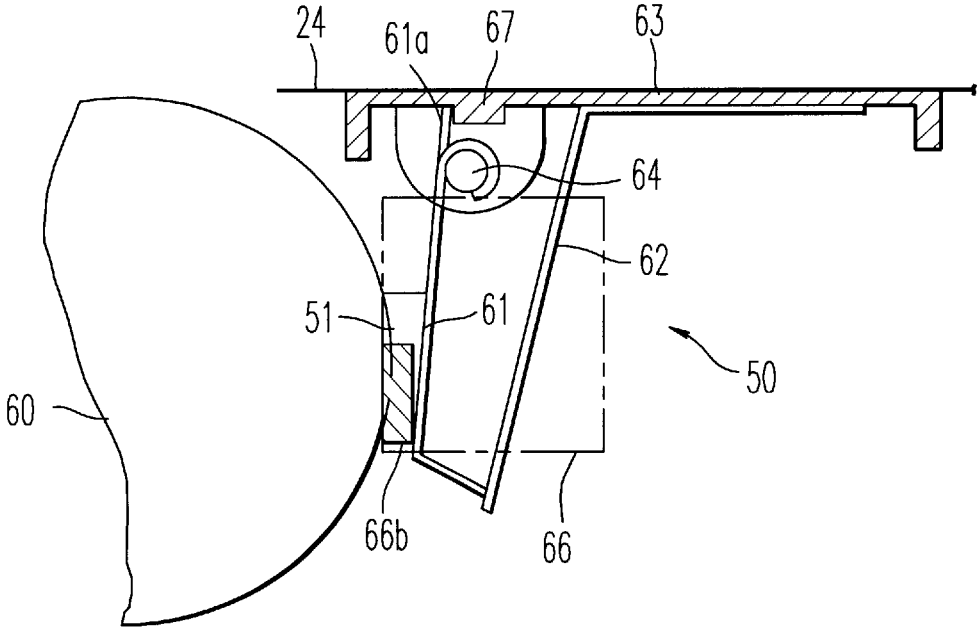
FIG. 10 is a schematic drawing for explaining a regulating device to regulate movement of a bracket of the release agent applying device not to contact a surface of the transfer roller.

Further, the release agent applying device 50 may be provided with a supporting member 66 to regulate the axis 64 inserted into the U-shaped groove 63*b* from coming off the groove 63*b* when the axis 64 is inserted into the U-shaped groove 63*b*, see also FIG. 10. The supporting member 66 is formed with a regulating part 66*b* to regulate movement of the bracket 61 towards the transfer roller 60 around the axis 64 at each end of the bracket 61.

Accordingly even when the release agent 51 is worn after long usage, because movement of the bracket 61 towards the transfer roller 60 is restricted by the regulating part 66*b*, the bracket 61 is prevented from directly contacting and damaging the surface of the transfer roller 60.

The support member 66 is fixed to the guide member 63 by inserting and screwing a screw, which is inserted into a hole 66*c* formed in a side plate of the support member 66, into a screw hole 63*c* formed in a plane of the guide member 63 where the U-shaped groove 63*b* is formed.

Thus, the image forming apparatus of this invention thrusts the release agent 51 to the surface of the transfer roller 60 by rotatably supporting the axis 64, which is fixed at each end of the upper part of the bracket 61 supporting the release agent 51, by the guide plate 63, and by pressing the bracket 61 towards the transfer roller 60 by the plurality of plate springs 62.

Therefore, if the transfer roller 60 rotates, the release agent 51 is uniformly applied to the surface of the transfer roller 60 to form a layer of the release agent 51 thereupon. Toner and an alien substance, such as, for example, paper dust, thereby hardly adheres to a surface of the coated layer of the release agent 51, and further, even when toner and/or paper dust are put on the surface of the coated layer of the release agent 51, such toner and/or paper dust can be easily removed. Thus, lowering of image quality due to insufficient cleaning of the transfer roller 60 is avoided.

Further, because the release agent applying device 50 is constructed in an integrated assembly, such that the release agent 51 is integrally supported by the bracket 61 and the bracket 61 is integrally and rotatably supported by the guide plate 63, the release agent applying device 50 can be easily mounted to the transfer unit 23 at a predetermined position.

Further, the guide member 63 includes, at a plane facing the bracket 61, a stopping member 67 to regulate bending of the bracket 61 towards a direction to separate from the transfer roller 60 at a center part of the bracket 61 by bringing the protruding pieces 61*a* into contact with the stopping member 67. Therefore, even when a thin plate is used for the bracket 61 for reducing cost and an axis is not provided in the center part of the bracket 61, and thereby the center part of the bracket 61 in the longitudinal direction is bent, the stopping member 67 regulates the bending of the bracket 61, such that the release agent 51 stably contacts the surface of the transfer roller 60.

Further, because the bracket 61 is mounted to the guide plate 63 by inserting the axis 64 at a rear side into the axis support hole 63*a*, inserting the axis 64 at a front side into the U-shaped groove 63*b* from below and supporting the axis 64 by the supporting member 66 from below, the bracket 61 can be easily mounted to the guide plate 63.

The release agent 51 and the transfer roller 60 wear after long usage and need to be replaced when they are worn. When either of the release agent 51 and the transfer roller 60 is replaced, before starting an image forming operation, it is necessary to apply the release agent 51 to the surface of the transfer roller 60 until a uniform layer of the release agent 51 is formed on the surface of the transfer roller 60, in other words, until the apparatus is brought into a state ready to start an image forming operation again.

Generally, a certain number of copies are made by a service person to bring the image forming apparatus to a state ready to start image forming again, which results in wasting transfer sheets and time.

Figure 11:
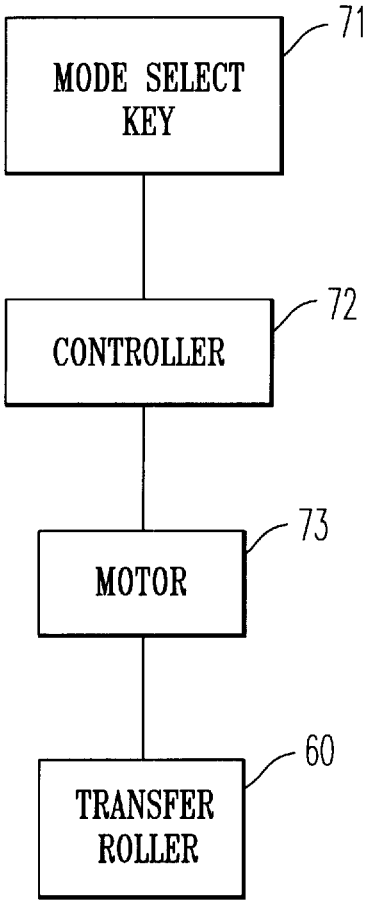
FIG. 11 is a block diagram for explaining that the transfer device is controlled through an operation of a mode select key to rotate only the transfer roller while stopping an image forming operation.

Therefore, in the image forming apparatus of this invention, as shown in FIG. 11, a controller 72 is provided to rotate only the transfer roller 60 a prescribed number of times while stopping an image forming operation including feeding of a transfer sheet 24. Further, a mode select key 71 is provided in an operational panel of the apparatus as a device for selecting a mode to stop the image forming operation and to rotate the transfer roller 60 alone for the prescribed number of times. The controller 72 may be conveniently implemented using a conventional microprocessor programmed according to the teachings of the present specification, as will be apparent to those skilled in the computer art.

Accordingly, when the transfer roller 60 or the release agent 51 is replaced, by selecting such a mode via the mode select key 71, the release agent 51 can be applied on the surface of the transfer roller 60 until a same uniform layer of the release agent 51 as before the replacement is formed on the surface of the transfer roller 60 without continuously forming images and wasting a large number of transfer sheets 24.

It is preferable that a number of times or a period of time to rotate the transfer roller 60 can be set arbitrarily to the controller 72 via a control panel, such that a service person can set an optimum number of times or an optimum period of time to rotate the transfer roller 60 in accordance with conditions of the release agent 51 or conditions of the transfer roller 60. For example, when the above-mentioned mode is selected via the mode select key 71, a display (not shown) in the operational panel displays a message requesting to input a desired number of times or a desired period of time to rotate the transfer roller 60. Then, the service person can input the desired number of times or the period of time via a ten key (not shown) in the operational panel. Thus, wasting of the release agent 51 and time are avoided.

Obviously, numerous additional modifications and variations of the present invention are possible in light of the above teachings. It is therefore to be understood that within the scope of the appended claims, the present invention may be practiced otherwise than as specifically described herein.

The present application is based on Japanese Priority Documents 08-189533 and 08-193564, the contents of which are incorporated herein by reference.

What is claimed as new and desired to be secured by Letters Patent of the United States is:

1. An image forming apparatus including an image carrier and a transfer device to transfer an image on the image carrier to a transfer sheet, the transfer device having a transfer roller and transferring an image on the image carrier to a transfer sheet conveyed between the transfer roller and the image carrier by applying a bias voltage to the transfer roller, the transfer device further comprising a release agent applying device to apply a release agent to a surface of the transfer roller.

2. The image forming apparatus according to claim 1, wherein the release agent is zinc stearate.

3. The image forming apparatus according to either one of claims 1 or 2, wherein the transfer device further comprises a cleaning member to clean the surface of the transfer roller.

4. An image forming apparatus including an image carrier and a transfer device to transfer an image on the image carrier to a transfer sheet, the transfer device having a transfer roller and transferring an image on the image carrier to a transfer sheet conveyed between the transfer roller and the image carrier by applying a bias voltage to the transfer roller, the transfer device further comprising a release agent applying device to apply a release agent to a surface of the transfer roller, wherein the transfer device further comprises a cleaning member to clean the surface of the transfer roller, and wherein a width of the release agent applied by the release agent applying device is narrower than a width the cleaning member cleans.

5. An image forming apparatus including an image carrier and a transfer device to transfer an image on the image carrier to a transfer sheet, the transfer device having a transfer roller and transferring an image on the image carrier to a transfer sheet conveyed between the transfer roller and the image carrier by applying a bias voltage to the transfer roller, the transfer device further comprising a release agent applying device to apply a release agent to a surface of the transfer roller, and wherein the release agent applying device applies the release agent to the surface of the transfer roller at all times when the transfer roller is rotating.

6. An image forming apparatus including an image carrier and a transfer device to transfer an image on the image carrier to a transfer sheet, the transfer device having a transfer roller and transferring an image on the image carrier to a transfer sheet conveyed between the transfer roller and the image carrier by applying a bias voltage to the transfer roller, the transfer device further comprising a release agent applying device to apply a release agent to a surface of the transfer roller, and wherein the release agent is solidified and contacts the surface of the transfer roller.

7. The image forming apparatus according to claim 6, wherein the transfer device further includes a guide member to guide a transfer sheet to an area between the transfer roller and the image carrier, the release agent applying device includes a bracket to hold the release agent along a longitudinal surface of the transfer roller and a pressing member to press the bracket so that the release agent contacts the longitudinal surface of the transfer roller, and the bracket being rotatably supported by the guide member.

8. The image forming apparatus according to claim 7, wherein the pressing member includes a plurality of pressing elements, being equally spaced from each other along the longitudinal direction of the transfer roller, and each of the plurality of the pressing elements presses the bracket with an equal pressing force.

9. The image forming apparatus according to claim 8, wherein a total pressing force pressing the bracket is between about 0.5 newton to about 2 newton.

10. The image forming apparatus according to claim 7, wherein the bracket includes at least one protruding piece at a center thereof in a longitudinal direction of the transfer roller and the guide member includes, at a plane facing the bracket, a stopping member to regulate bending of the bracket by bringing the at least one protruding piece into contact with the stopping member.

11. The image forming apparatus according to claim 7, wherein the bracket has an axis at each end, each axis protruding from the bracket, the guide member being formed with an opening for inserting the axis therein to support the axis protruding from a first side of the bracket and a U-shaped groove for inserting the axis thereto to support the axis protruding from a second side of the bracket, the transfer device further including a supporting member to prevent the axis inserted into the U-shaped groove from coming off the U-shaped groove when the axis is inserted into the U-shape groove, and the supporting member being formed with a regulating part to regulate rotational movement of the bracket towards the transfer roller around the axis at each end of the bracket.

12. An image forming apparatus including an image carrier and a transfer device to transfer an image on the image carrier to a transfer sheet, the transfer device having a transfer roller and transferring an image on the image carrier to a transfer sheet conveyed between the transfer roller and the image carrier by applying a bias voltage to the transfer roller, the transfer device further comprising a release agent applying device to apply a release agent to a surface of the transfer roller, and wherein the transfer device further includes an elastic intermediate agent applying member between the transfer roller and the release agent applying device so that the release agent is applied to the surface of the transfer roller via the elastic intermediate agent applying member.

13. An image forming apparatus including an image carrier and a transfer device to transfer an image on the image carrier to a transfer sheet, the transfer device having a transfer roller and transferring an image on the image carrier to a transfer sheet conveyed between the transfer roller and the image carrier by applying a bias voltage to the transfer roller, the transfer device further comprising a release agent applying device to apply a release agent to a surface of the transfer roller, and means for stopping an image forming operation while rotating the transfer roller.

14. The image forming apparatus according to claim 13, further comprising means for selecting a mode to stop an image forming operation while rotating the transfer roller.

15. An image transfer device for an image forming apparatus, including a transfer roller for transferring an image on an image carrier to a transfer sheet conveyed between the transfer roller and the image carrier by applying a bias voltage to the transfer roller, the transfer device comprising a device to apply a release agent to a surface of the transfer roller.

16. The image transfer device according to claim 15, wherein the release agent is zinc stearate.

17. The image transfer device according to either one of claims 15 or 16, wherein the transfer device further comprises a cleaning member to clean the surface of the transfer roller.

18. An image transfer device for an image forming apparatus, including a transfer roller for transferring an image on an image carrier to a transfer sheet conveyed between the transfer roller and the image carrier by applying a bias voltage to the transfer roller, the transfer device comprising a device to apply a release agent to a surface of the transfer roller, wherein the transfer device further comprises a cleaning member to clean the surface of the transfer roller, and wherein a width of the release agent applied by the release agent applying device is narrower than a width the cleaning member cleans.

19. An image transfer device for an image forming apparatus, including a transfer roller for transferring an image on an image carrier to a transfer sheet conveyed between the transfer roller and the image carrier by applying a bias voltage to the transfer roller, the transfer device comprising a device to apply a release agent to a surface of the transfer roller, wherein the release agent applying device applies the release agent to the surface of the transfer roller at all times when the transfer roller is rotating.

20. An image transfer device for an image forming apparatus, including a transfer roller for transferring an image on an image carrier to a transfer sheet conveyed between the transfer roller and the image carrier by applying a bias voltage to the transfer roller, the transfer device comprising a device to apply a release agent to a surface of the transfer roller, wherein the release agent is solidified and contacts the surface of the transfer roller.

21. The image transfer device according to claim 20, the transfer device further includes a guide member to guide a transfer sheet to an area between the transfer roller and the image carrier, the release agent applying device includes a bracket to hold the release agent along a longitudinal surface of the transfer roller and a pressing member to press the bracket so that the release agent contacts the longitudinal surface of the transfer roller, and the bracket being rotatably supported by the guide member.

22. The image transfer device according to claim 21, wherein the pressing member includes a plurality of pressing elements, being equally spaced from each other along the longitudinal direction of the transfer roller, and each of the plurality of the pressing elements presses the bracket with an equal pressing force.

23. The image transfer device according to claim 22, wherein a total pressing force pressing the bracket is between about 0.5 newton to about 2 newton.

24. The image transfer device according to claim 21, wherein the bracket includes at least one protruding piece at a center thereof in a longitudinal direction of the transfer roller and the guide member includes at a plane facing the bracket, a stopping member to regulate bending of the bracket by bringing the at least one protruding piece into contact with the stopping member.

25. The image transfer device according to claim 21, wherein the bracket has an axis at each end, each axis protruding from the bracket, the guide member being formed with an opening for inserting the axis therein to support the axis protruding from a first side of the bracket and a U-shaped groove for inserting the axis thereto to support the axis protruding from a second side of the bracket, the transfer device further including a supporting member to prevent the axis inserted into the U-shaped groove from coming off the U-shaped groove when the axis is inserted into the U-shape groove, and the supporting member being formed with a regulating part to regulate rotational movement of the bracket towards the transfer roller around the axis at each end of the bracket.

26. An image transfer device for an image forming apparatus, including a transfer roller for transferring an image on an image carrier to a transfer sheet conveyed between the transfer roller and the image carrier by applying a bias voltage to the transfer roller, the transfer device comprising a device to apply a release agent to a surface of the transfer roller, wherein the transfer device further includes an elastic intermediate agent applying member between the transfer roller and the release agent applying device so that the release agent is applied to the surface of the transfer roller via the intermediate agent applying member.

27. The image forming apparatus according to any one of claims 4–14 or 18–26, wherein the release agent is zinc stearate.

* * * * *